US006295829B1

(12) United States Patent
Gibot

(10) Patent No.: US 6,295,829 B1
(45) Date of Patent: Oct. 2, 2001

(54) REFRIGERATED CATERING SERVICE TROLLEY AND INSTALLATION FOR RELOADING REFRIGERATING AGENT

(75) Inventor: Claude Gibot, Clichy Sous Bois (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/380,596

(22) PCT Filed: Mar. 6, 1998

(86) PCT No.: PCT/FR98/00452

§ 371 Date: Sep. 13, 1999

§ 102(e) Date: Sep. 13, 1999

(87) PCT Pub. No.: WO98/40680

PCT Pub. Date: Sep. 17, 1998

(30) Foreign Application Priority Data

Mar. 11, 1997 (FR) ..... 97 02871

(51) Int. Cl.[7] ..... F25D 3/08
(52) U.S. Cl. ..... 62/371; 62/457.2; 62/530
(58) Field of Search ..... 62/530, 532, 457.2, 62/239, 384, 371

(56) References Cited

U.S. PATENT DOCUMENTS

| | | | | |
|---|---|---|---|---|
| 1,965,205 | | 7/1934 | Smith . | |
| 2,071,302 | | 2/1937 | Hill . | |
| 2,214,347 | | 9/1940 | Post . | |
| 3,906,744 | * | 9/1975 | Knapp et al. | 62/384 |
| 4,457,142 | | 7/1984 | Bucher . | |
| 4,898,294 | | 2/1990 | Jennings . | |
| 4,936,377 | * | 6/1990 | DeVogel et al. | 165/47 |

FOREIGN PATENT DOCUMENTS

| | | | | |
|---|---|---|---|---|
| 0 066 547 | | 12/1974 | (EP) . | |
| 0 080 313 | | 6/1983 | (EP) . | |
| 0 591 047 | | 4/1994 | (EP) . | |
| 0 745 816 | | 12/1996 | (EP) . | |
| 671 566 | | 12/1929 | (FR) . | |
| 677 429 | | 3/1930 | (FR) . | |
| 37 970 | | 2/1931 | (FR) . | |
| 780 534 | | 4/1935 | (FR) . | |
| 2188122 | | 1/1974 | (FR) . | |
| 2216531 | | 8/1974 | (FR) . | |
| 2171189A | * | 8/1986 | (GB) | 62/457.2 |

* cited by examiner

*Primary Examiner*—William Doerrler
*Assistant Examiner*—Melvin Jones
(74) *Attorney, Agent, or Firm*—Burns, Doane, Swecker & Mathis, L.L.P.

(57) ABSTRACT

Provided are catering service trolleys for preserving and distributing meal service trays in aeroplanes. The trolley includes side walls with double shells defining vertical channels opening at their upper part into the housing containing the refrigerating agent and at their lower part in the proximity of the bottom of the section receiving the meal-trays, thus enabling the refrigerating gas to circulate by convection over the whole height of the trolley and a more homogeneous temperature distribution.

18 Claims, 3 Drawing Sheets

REFRIGERATED CATERING SERVICE TROLLEY AND INSTALLATION FOR RELOADING REFRIGERATING AGENT

DETAILED DESCRIPTION OF PREFERRED EMBODIMENTS (i) Field of the Invention

The invention relates to trolleys used for preserving and distributing perishable foodstuffs, particularly in aircraft.

These trolleys used for distributing meal service trays during air trips are produced in the form of a thermally insulated aluminum or light-alloy structure provided with a front door and delimiting a particular number of rails, on which the trays are arranged. A removable tank arranged in the upper part of the trolley makes it possible to load a reserve of a refrigerating or cooling agent intended for ensuring that the transported foodstuffs are maintained at a good temperature.

(ii) Description of Related Art

It has been found, then, that, in the known trolleys, the refrigerating agent lacks efficiency. The meal service trays located in the upper part of the trolley are too chilled, whilst those arranged in the lower part are not chilled sufficiently. Moreover, where long trips are concerned, the temperature of the meal service trays as a whole may become too high.

SUMMARY OF THE INVENTION

The main object sought after here is to improve the efficiency and uniformity of chilling in the entire volume of the trolley and also to improve the operating conditions and operating costs.

To achieve this, the main subject of the invention is a trolley for preserving and distributing foodstuffs, in particular for distributing meal service trays in aircraft, comprising a metallic structure of general parallelepipedic shape provided with a door in its front wall and delimiting, on the one hand, a receptacle in its upper part for receiving a removable tank designed to contain a refrigerating agent and, on the other hand, a compartment, in which the foodstuffs are arranged, characterized in that at least the two side walls of the metallic structure comprise two metal plates separated by a layer of insulating material, gas circulation ducts being delimited between the inner metal plate and the insulating material, said gas circulation ducts being open in their upper and lower parts and opening respectively into the upper receptacle, in which the tank containing the refrigerating agent is located, and into the low part of the compartment in which the foodstuffs are arranged.

According to other characteristics:

- the receptacle and the compartment are separated by a partition forming a thermal shield;
- the layer of insulating material comprises ribs which are in contact with the inner plate and which delimit said ducts between them;
- vertical battens are provided between the inner plate and the layer of insulating material;
- the lower edges of the inner plate and of the layer of insulating material are spaced from the bottom wall of the compartment;
- the trolley comprises two compartments for receiving the foodstuffs and two receptacles, each receiving a tank containing the refrigerating agent, these various compartments and receptacles being separated by partitions forming a thermal shield.

Another subject of the invention is an installation for reloading tanks with refrigerating agent, characterized in that it comprises a stand, a source of liquid refrigerating agent, means of distributing this agent, comprising an injection nozzle, control means for metering the quantity of agent introduced into the tank, a container designed for receiving a tank and for positioning it relative to the injection nozzle, a shutoff member for closing the tank during the injection phase, and a circuit for discharging the gases which are released during this same injection phase.

The invention will be described in more detail below with reference to the accompanying drawings.

DETAILED DESCRIPTION OF THE PREFERRED EMBODIMENTS

Figure 1:
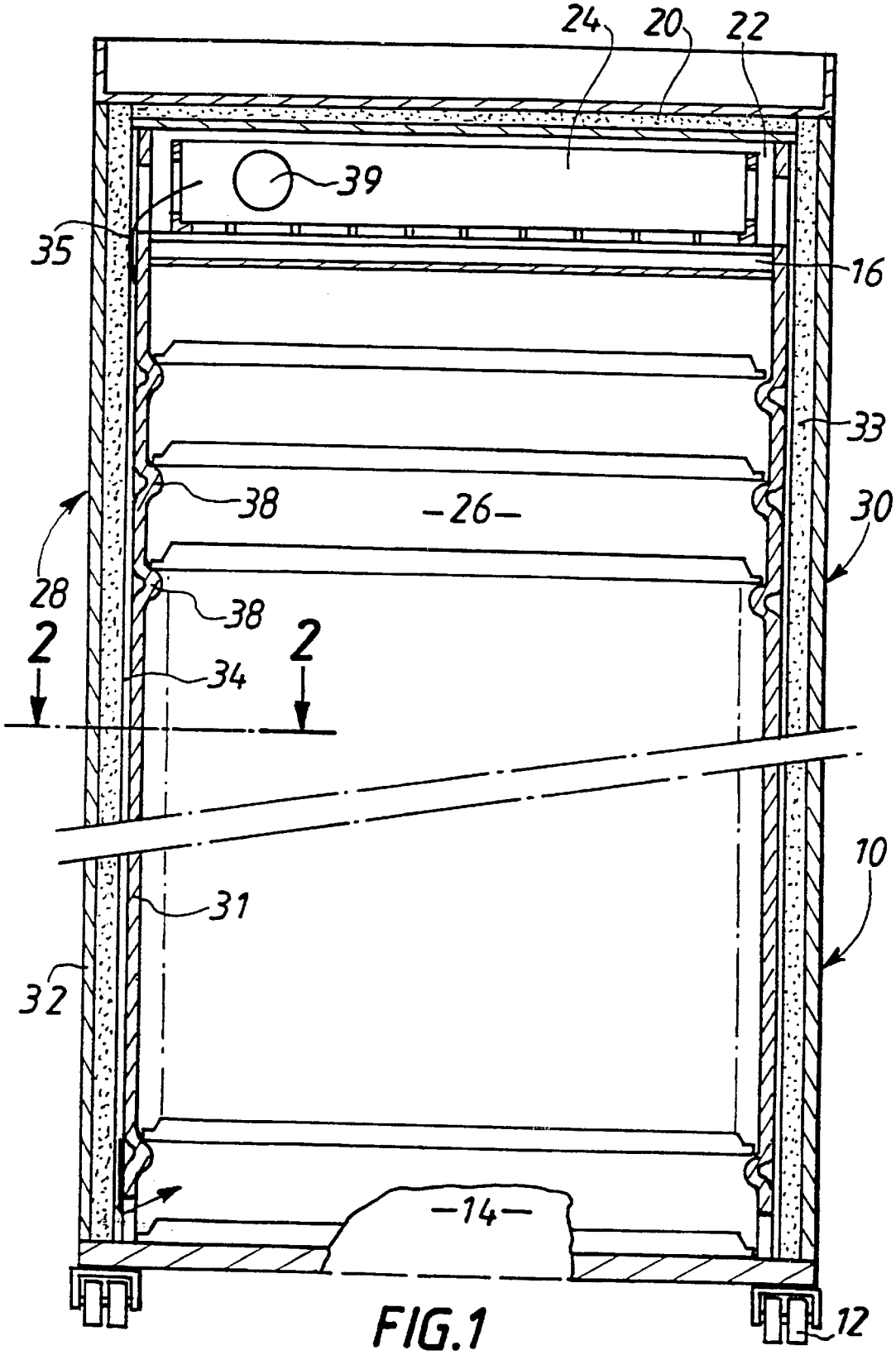
FIG. 1 is a sectional view of a trolley according to the invention along a vertical plane parallel to the front face of this trolley.

FIG. 1 shows a trolley, such as is used for ensuring the preservation and distribution of meal service trays in aircraft.

Only the parts of this trolley which are original and are modified in accordance with the invention will be described in more detail.

A trolley of general parallelepipedic shape consists of a metallic structure 10 which is provided with wheels 12 and the front face 14 of which is equipped with a door. An intermediate partition 16, parallel to the bottom 18 and to the upper face 20 of the trolley, divides the inner volume of the latter into two parts: an upper receptacle 22 of low height, intended for receiving a removable tank 24, and a lower compartment 26, representing the essential volume and intended for receiving the meal service trays.

This partition 16 separating the upper receptacle from the lower compartment is produced so as to form a thermal shield. Moreover, the trolley as a whole is virtually produced so as to have isothermal properties, and its walls are preferably produced from a sandwich-type material having thermal insulation properties.

Figure 2:
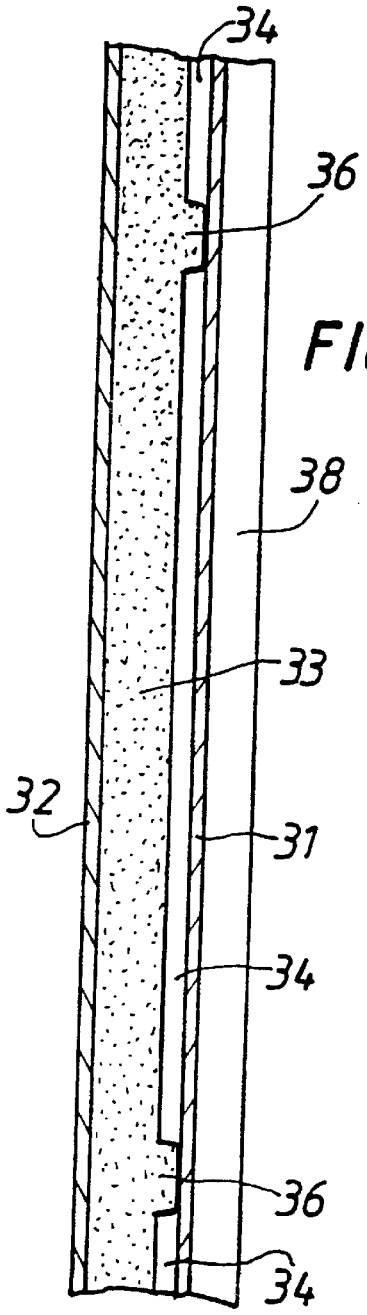
FIG. 2 is a partial sectional view of a portion of side wall along the line 2—2 of FIG. 1.

According to the invention, the two side walls 28, 30 of the trolley, which are formed from two metal plates 31, 32 between which a layer 33 of thermal insulating material is interposed, are produced so as to delimit vertical gas circulation ducts 34. For this purpose, the insulating material is shaped or molded so as to delimit projecting parts or vertical ribs 36 which are adhesively bonded to the inner metal plate 31 and which delimit the abovementioned ducts between them (FIG. 2).

At their upper ends, these ducts open out freely at 35 into the upper compartment 22 of the trolley. At their lower ends, the inner metal plate and the insulating material are interrupted at a distance of the order of a few centimeters from the bottom of the trolley, so that the ducts open out freely in the vicinity of the bottom of the latter.

In a known way, the inner metal plates 31 of the side walls comprise ribs 38 which form rails designed for slidably receiving the meal service trays.

Preferably, the inner metal plate extends as far as a level located at a short distance below the lower rail delimited by this plate.

The removable tank 24 intended for containing the refrigerating product is, as a whole, of conventional design and comprises a bottom and side walls which are provided with apertures. Moreover, this tank comprises, in its rear wall, an orifice 39 intended for making it possible to reload it with refrigerating agent.

In a known way, this tank may be arranged in the upper compartment of the trolley so as to delimit a gap between its bottom and the intermediate partition 16.

Such a trolley functions as follows: the removable tank 24 containing a refrigerating agent consisting preferably of a quantity of carbon dioxide snow or dry ice, said quantity being determined as a function of the necessary preservation time, is arranged in the upper compartment of the trolley. This refrigerant is slowly sublimated and, due to the presence of the ducts 34 delimited in the side walls 31, 32 of the trolley, natural convection circulation is established within the double casing, formed by each of these side walls, and in the lower part of the trolley.

By contrast, the partition 16 forming a thermal shield blocks the cooling radiation.

The compartment as a whole is thus chilled substantially uniformly over its entire height. The main object sought after is therefore effectively achieved, since all the meal service trays arranged in the trolley are chilled substantially in the same way, whether they are placed in the lower part or in the upper part of the compartment.

Furthermore, by virtue of the recesses made in the insulating material arranged between the two metal plates 31, 32, a weight gain is obtained, without the thermal insulation efficiency of the thermally insulating complex thereby being diminished, since the gas circulating in the ducts of the double casing possesses insulation properties substantially equivalent to those of the insulating layer.

Alternatively, battens separate from the layer 33 of insulating material may be provided in order to delimit the ducts 34.

Figure 3:
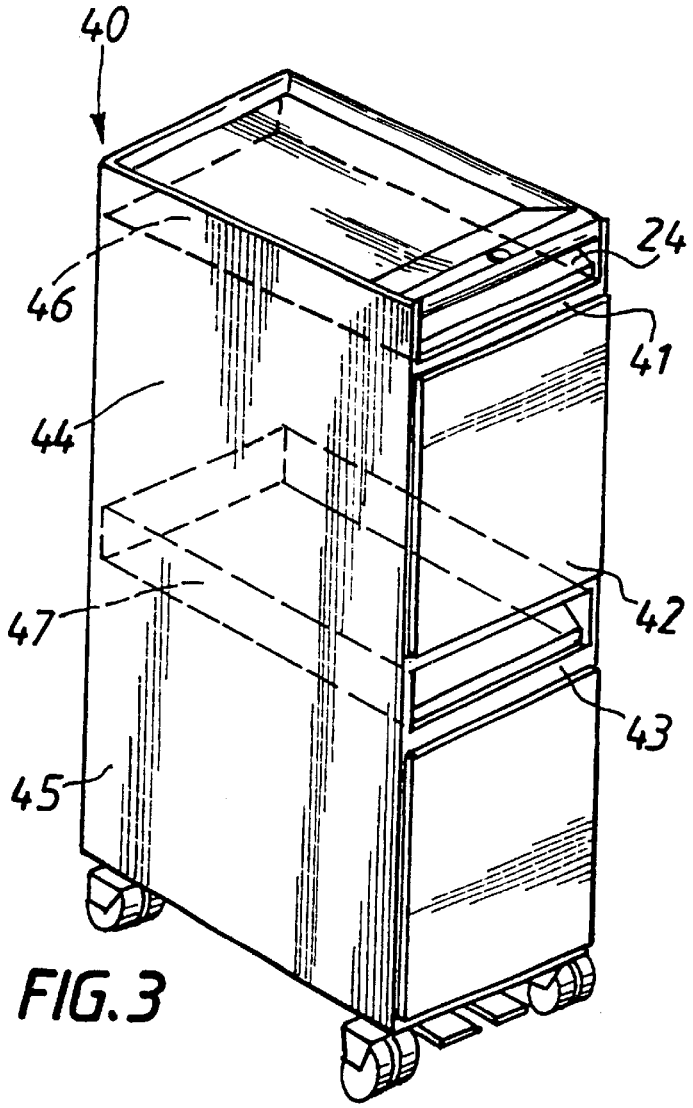
FIG. 3 is a diagrammatic perspective view of an alternative embodiment of such a trolley.

FIG. 3 illustrates an alternative embodiment, in which the trolley 40 is divided vertically into four compartments by means of three partitions 41, 42, 43 forming thermal shields. Two compartments 44, 45 of relatively large dimensions are each associated, as in the embodiment of FIG. 1, with a compartment 46, 47 of low height, in which a removable tank containing a reserve of refrigerating agent is located. A compartment 44 or 45 for receiving the trays and a compartment 46 or 47 for receiving the removable tank form a subassembly similar to that described in relation to FIG. 1.

Such an arrangement makes it possible to double the quantity of refrigerating agent and therefore increase the preservation time of the products.

Another way of obtaining this result is to increase the height of the upper compartment and the capacity of the tank containing the refrigerating agent.

Figure 4:
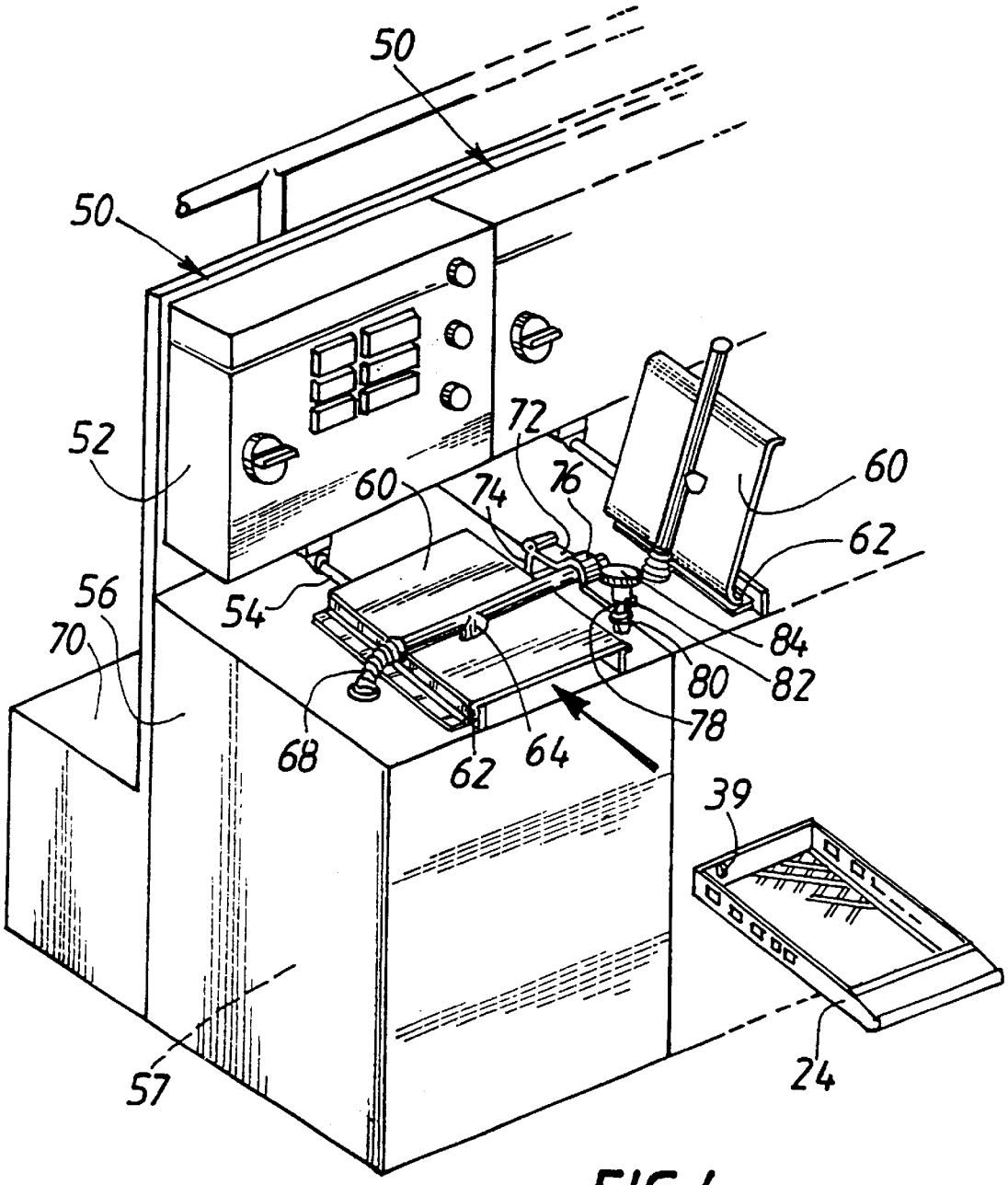
FIG. 4 is a diagrammatic perspective view of an installation for reloading the tanks with refrigerating agent.

Another subject of the invention is an insulation making it possible to reload the removable tanks with refrigerating agent and, more particularly, with carbon dioxide snow. This installation (FIG. 4) comprises preferably a plurality of reloading stations 50, each comprising a distributor 52 which is connected to a source of liquid $CO_2$ and the outlet member of which consists of an injection nozzle 54, and control means making it possible to meter the quantity of product introduced into the tank. Such distributing and control means are described, for example, in the documents FR-A-94 12 829 and EP-A-631096.

This reloading station comprises a stand 56 which delimits an enclosure 57 and on which is provided a container 58 designed for receiving a tank to be reloaded. The container ensures that the tank is positioned in such a way that the nozzle for the injection of liquid $CO_2$ fits into the orifice 39 made in the rear wall of the tank.

A cover 60 articulated along one of its edges 62 on the stand is intended to fit sealingly onto the upper face of the tank. This cover comprises an orifice connected sealingly to a gas discharge duct 64. This duct is produced in the form of a tube 66 connected at one end, by means of a flexible elbow 68, to the enclosure 57 which is itself connected to a gas extraction system 70.

In the embodiment described, the tube 66 is extended beyond its fastening to the cover, in order to form a blocking member by cooperation with a lug 72 articulated, at one of its ends, on a support 74 and comprising, in its middle part, a substantially semicylindrical bearing surface 76, said lug being intended to cooperate with the end of the tube and comprising, at its other end, an indentation 78, into which can engage a threaded rod 80 mounted tiltably on the stand and capable of cooperating with a nut 82 provided with a knurled knob 84. This end of the tube 66 is, of course, shut off.

In order to put in place a tank which is to be reloaded, it is sufficient for the nut 82 to be slackened slightly, the cover then being raised sufficiently to make it possible to put the tank in place. The nut is subsequently tightened in order to ensure sealing contact between the cover and the tank to be reloaded. Since the quantity of liquid $CO_2$ to be injected has been selected beforehand, it is sufficient for the operator to trigger this injection which is subsequently stopped automatically. The gas generated during the conversion of liquid $CO_2$ under pressure into carbon dioxide snow is discharged via the tubing 64, 66 in the direction of the enclosure 57 and then of the extraction system 70.

The lug 72 may be released from the assembly composed of the threaded rod 80 and of the nut 82, in order to make it possible to open the cover completely and make the cleaning operations easier.

The presence of a plurality of modular filling units similar to that just described makes it possible to reload very efficiently the tanks which contain the refrigerating agent, and this operation may be carried out in parallel, thus representing a very appreciable saving.

Moreover, the quantity of refrigerating agent introduced into each tank may easily be adapted to the duration of the trip, thus making it possible to optimize the consumption of $CO_2$ and the operating costs.

Other reloading methods may, of course, be used, for example by means of wafers of dry ice or any other suitable product.

What is claimed is:

1. A trolley for preserving and distributing foodstuffs comprising a metallic structure comprising:

an opening for inserting and removing the foodstuff;

an upper compartment comprising a receptacle for receiving a removable tank designed to include a refrigerating agent;

a lower foodstuffs compartment, including a bottom wall, at least two side walls comprising an inner metal plate and an outer metal plate separated by a layer of insulating material, gas circulation ducts delimited between the inner metal plate and the insulating material, wherein said ducts include upper and lower parts which open, respectively, into the receptacle of the upper compartment, in which the tank containing the refrigerating agent is located, and into a lower part of the foodstuffs compartment, and wherein said ducts are effective to establish natural convection circulation of the refrigerating agent within the ducts and in the lower part of the trolley.

2. The trolley according to claim 1, wherein the foodstuffs which are distributed are meal service trays in an aircraft.

3. The trolley according to claim 1, wherein said metallic structure is of a general parallelepiped shape.

4. The trolley according to claim 3, wherein said opening for inserting and removing the foodstuff is a door.

5. The trolley according to claim 4, wherein said door is provided in a front wall of said metallic structure of parallelepiped shape.

6. The trolley according to claim 1, further comprising a partition forming a thermal shield which separates the receptacle in the upper compartment and the foodstuffs compartment.

7. The trolley according to claim 1, wherein said inner plate and said layer of insulating material have lower edges which are spaced from the bottom wall of the foodstuffs compartment.

8. The installation according to claim 7, wherein said shutoff member comprises a cover articulated along one of its sides on the stand and, on its opposite side, means for blocking said tank into the closed position.

9. An installation for reloading tanks with a refrigerant comprising:

the trolley according to claim 1;

a stand;

a source of a liquid refrigerating agent;

a distributor for said liquid refrigerating agent comprising an injection nozzle and a controller which meters the quantity of agent introduced into said tank;

a container designed for receiving said tank and for positioning it relative to said injection nozzle;

a shutoff member for closing the tank during injection; and a circuit for discharging gases which are released during injection.

10. A trolley for preserving and distributing foodstuffs comprising a metallic structure comprising:

an opening for inserting and removing the foodstuff;

an upper compartment comprising a receptacle for receiving a removable tank designed to include a refrigerating agent;

a lower foodstuffs compartment, including a bottom wall, at least two side walls comprising an inner metal plate and an outer metal plate separated by a layer of insulating material, gas circulation ducts delimited between the inner metal plate and the insulating material, wherein said ducts include upper and lower parts which open, respectively, into the receptacle of the upper compartment, in which the tank containing the refrigerating agent is located, and into a lower part of the foodstuffs compartment, wherein the layer of insulating material further comprises ribs which are in contact with the inner plate and which delimit said ducts between them.

11. A trolley for preserving and distributing foodstuffs comprising a metallic structure comprising:

an opening for inserting and removing the foodstuff;

an upper compartment comprising a receptacle for receiving a removable tank designed to include a refrigerating agent;

a lower foodstuffs compartment, including a bottom wall, at least two side walls comprising an inner metal plate and an outer metal plate separated by a layer of insulating material, gas circulation ducts delimited between the inner metal plate and the insulating material, wherein said ducts include upper and lower parts which open, respectively, into the receptacle of the upper compartment, in which the tank containing the refrigerating agent is located, and into a lower part of the foodstuffs compartment, further comprising vertical battens between the inner plate and the layer of insulating material.

12. A trolley for preserving and distributing foodstuffs comprising a metallic structure comprising:

an opening for inserting and removing the foodstuff;

an upper compartment comprising a receptacle for receiving a removable tank designed to include a refrigerating agent;

a lower foodstuffs compartment, including a bottom wall, at least two side walls comprising an inner metal plate and an outer metal plate separated by a layer of insulating material, gas circulation ducts delimited between the inner metal plate and the insulating material, wherein said ducts include upper and lower parts which open, respectively, into the receptacle of the upper compartment, in which the tank containing the refrigerating agent is located, and into a lower part of the foodstuffs compartment, and further comprising two foodstuffs compartments and two receptacles for receiving a tank containing a refrigerating agent, wherein each foodstuff compartment is separated from its respective receptacle by a partition forming a thermal shield.

13. The installation according to claim 12, wherein said refrigerating agent is carbon dioxide snow.

14. The installation according to claim 13, wherein said blocking means comprises a lug articulated at one end on the stand, cooperating in its middle part with a member fixed to the cover and comprising, at its other end, a removable clamp.

15. The installation according to claim 14, wherein said tube is fastened to the shutoff member and is connected to the stand with a flexible elbow.

16. The installation according to claim 12, wherein said circuit for discharging said gases comprises a duct extending from the shutoff member and a tube connected to an enclosure which itself is connected to a gas extraction system.

17. The installation according to claim 16, wherein said tube extends beyond the duct so as to form a member which retains and blocks the cover in the closed position.

18. The installation according to claim 12, further comprising a plurality of juxtaposed stations for reloading the tanks.

* * * * *